US008887411B2

(12) United States Patent
Lacorazza et al.

(10) Patent No.: US 8,887,411 B2
(45) Date of Patent: Nov. 18, 2014

(54) ATHLETIC SHOE HAVING A SEGMENTED UPPER

(75) Inventors: David Lacorazza, Canton, MA (US); Torill Flyen, Everett, MA (US); Robert Ruth, Canton, MA (US); Xiaofan Yu, Canton, MA (US)

(73) Assignee: Reebok International Limited, London (GB)

( * ) Notice: Subject to any disclaimer, the term of this patent is extended or adjusted under 35 U.S.C. 154(b) by 1154 days.

(21) Appl. No.: 11/733,626

(22) Filed: Apr. 10, 2007

(65) Prior Publication Data

US 2008/0083138 A1 Apr. 10, 2008

Related U.S. Application Data

(63) Continuation-in-part of application No. 11/496,714, filed on Aug. 1, 2006.

(51) Int. Cl.

| | |
|---|---|
| ***A43B 23/04*** | (2006.01) |
| ***A43B 7/14*** | (2006.01) |
| ***A43B 3/26*** | (2006.01) |
| ***A43B 1/00*** | (2006.01) |
| ***A43B 23/02*** | (2006.01) |

(52) U.S. Cl.

CPC ..... *A43B 3/26* (2013.01); *A43B 23/047* (2013.01); *A43B 1/0018* (2013.01); *A43B 23/0255* (2013.01); *A43B 23/027* (2013.01); *A43B 23/0295* (2013.01)

USPC ..... 36/88; 36/45

(58) Field of Classification Search

CPC .... A43B 1/0018; A43B 3/26; A43B 23/0205; A43B 23/0265; A43B 23/027; A43B 23/0275; A43B 23/047

USPC ..... 36/45, 88, 93, 97

See application file for complete search history.

(56) References Cited

U.S. PATENT DOCUMENTS

| | | | | |
|---|---|---|---|---|
| 5,533,279 | A | 7/1996 | Mitsui et al. | |
| 5,765,296 | A * | 6/1998 | Ludemann et al. | 36/51 |
| 6,367,171 | B1 * | 4/2002 | Burt | 36/100 |
| 6,519,876 | B1 * | 2/2003 | Geer et al. | 36/76 R |
| 6,533,885 | B2 | 3/2003 | Davis et al. | |
| D518,283 | S | 4/2006 | Kayano et al. | |
| 7,055,268 | B2 * | 6/2006 | Ha | 36/97 |
| D527,174 | S | 8/2006 | Kayano et al. | |

(Continued)

FOREIGN PATENT DOCUMENTS

DE 19631339 A1 * 2/1998

OTHER PUBLICATIONS

Footwear News advertisement showing Reebok's Premier Trinity KFS, dated Jan. 30, 2006.

*Primary Examiner* — Jila M Mohandesi
*Assistant Examiner* — Sharon M Prange
(74) *Attorney, Agent, or Firm* — Sterne, Kessler, Goldstein & Fox P.L.L.C.

(57) ABSTRACT

A shoe having an improved upper, and method of manufacture are presented herein. The upper is generally comprised of a plurality of non-stretch panels interlinked with at least one stretchable expansion joint. The stretchable expansion joint provides relative movement between the plurality of non-stretch panels such that the upper mimics the relative movement between the bone structures of a wearer's foot.

18 Claims, 12 Drawing Sheets

(56) References Cited

U.S. PATENT DOCUMENTS

| | | | | |
|---|---|---|---|---|
| 7,082,703 | B2 * | 8/2006 | Greene et al. | 36/89 |
| D527,516 | S | 9/2006 | Kayano et al. | |
| D528,761 | S | 9/2006 | Kayano et al. | |
| 7,823,298 | B2 * | 11/2010 | Nishiwaki et al. | 36/88 |
| 2004/0261295 | A1 * | 12/2004 | Meschter | 36/45 |
| 2005/0115112 | A1 * | 6/2005 | Bonfanti | 36/97 |
| 2006/0162190 | A1 | 7/2006 | Nishiwaki et al. | |
| 2007/0039208 | A1 * | 2/2007 | Bove et al. | 36/97 |
| 2007/0039209 | A1 * | 2/2007 | White et al. | 36/97 |

* cited by examiner

ATHLETIC SHOE HAVING A SEGMENTED UPPER

CROSS-REFERENCE TO RELATED PATENT APPLICATION

This application is a Continuation-in-Part of U.S. patent application Ser. No. 11/496,714, filed Aug. 1, 2006, the entire disclosure of which is incorporated herein by reference.

BACKGROUND OF THE INVENTION

1. Field of the Invention

The present invention relates to athletic footwear, and more specifically to an improved upper for an athletic shoe.

2. Background Art

Athletic footwear must provide stable and comfortable support for the foot. Specifically, it is important that the footwear be comfortable while providing adequate support during various foot movements associated with athletic activity. Athletic footwear typically includes an upper and a sole, and is sold in a variety of sizes according to the length and width of the foot. The standard upper, however, is typically constructed of one mesh material, with minimal stretch.

FIG. 1 shows a skeletal depiction of a foot 100. There are three main divisions to the foot. Portions of the foot include rear foot 102, midfoot 104, and forefoot 106. The rear foot 102 includes the talus 108 and the calcaneus 110. The midfoot 104 includes three cuneiforms 112, cuboid 114 and navicular 116. The forefoot 106 includes metatarsal 118, proximal phalanges 120, and distal phalanges 122.

While the three main divisions of the foot are linked to each other, it is not uncommon for the three main divisions to move relative to each other during athletic activity. Although many products are designed to accommodate the shape of a foot when the foot is static, the problems associated with the fit of an upper during dynamic movement of the foot have not been adequately addressed. Specifically, the standard design of an athletic shoe, which includes only a continuous upper structure, does not provide adequate mobility between the three main divisions of the foot, i.e., rearfoot 102, midfoot 104, and forefoot 106.

BRIEF SUMMARY OF THE INVENTION

This brief summary is intended to summarize the claims filed in the present patent application. This summary is not intended to be limiting. Therefore, the filed claims, and any future iterations of the claims, should not be limited by this summary.

Presented herein is a shoe having an improved upper. The upper is generally comprised of a plurality of non-stretch panels interlinked with at least one stretchable expansion joint. The stretchable expansion joint provides relative movement between the plurality of non-stretch panels such that the upper mimics the relative movement between the bone structures of a wearer's foot.

In one embodiment presented herein, there is provided an article of footwear having a sole and an upper attached to the sole, wherein the upper is comprised of at least four non-stretch panels and at least one expansion joint formed of a stretch material. The expansion joint has an approximate X-shape configuration. The X-shape configuration forms four quadrants about a center point. Each of the four non-stretch panels is disposed in one of the four quadrants formed by the X-shape configuration. In one embodiment, the X-shape configuration is formed by four extensions departing from the center point, two of the extensions extending from the center point to a front portion of the sole, one extension extending from the center point to a medial side of the sole, and one extension extending from the center point to a lateral side of the sole. In one embodiment, the center point is located in an area corresponding to a forefoot portion of the sole. The expansion joint may be formed of a two-way expandable material or a four-way expandable material. The expansion joint may be formed of a spandex material or a spandex material having a polyurethane coating. In one embodiment, a portion of the expansion joint is about three millimeter to about four millimeters wide. In one embodiment, the expansion joint is comprised of a material having a stretch retention of less than about 15%, and preferably less than about 5%.

In accordance with another embodiment presented herein, there is provided an article of footwear having a sole and an upper attached to the sole, wherein the upper is comprised of a forefoot portion, an expansion joint coupled to the forefoot portion, and a rearfoot portion coupled to the rearfoot portion. The forefoot portion and the rearfoot portion are formed of non-stretch materials. The expansion joint is formed of a stretch material having a stretch retention of less than about 15%, and preferably less than about 5%. The expansion joint extends from a medial side of the sole to a lateral side of the sole.

BRIEF DESCRIPTION OF THE DRAWINGS/FIGURES

The accompanying figures, which are incorporated herein and form part of the specification, illustrate an athletic shoe. Together with the description, the figures further serve to explain the principles of the athletic shoe described herein and thereby enable a person skilled in the pertinent art to make and use the athletic shoe.

DETAILED DESCRIPTION OF THE INVENTION

Preferred embodiments of an athletic shoe are described below with reference to the figures where like reference numbers indicate identical or functionally similar elements. Also in the figures, the left most digit of each reference number corresponds to the figure in which the reference number is used. While specific configurations and arrangements are discussed, it should be understood that this is done for illustrative purposes only. A person skilled in the relevant art will recognize that other configurations and arrangements can be used without departing from the spirit and scope of the appended claims.

Figure 2:
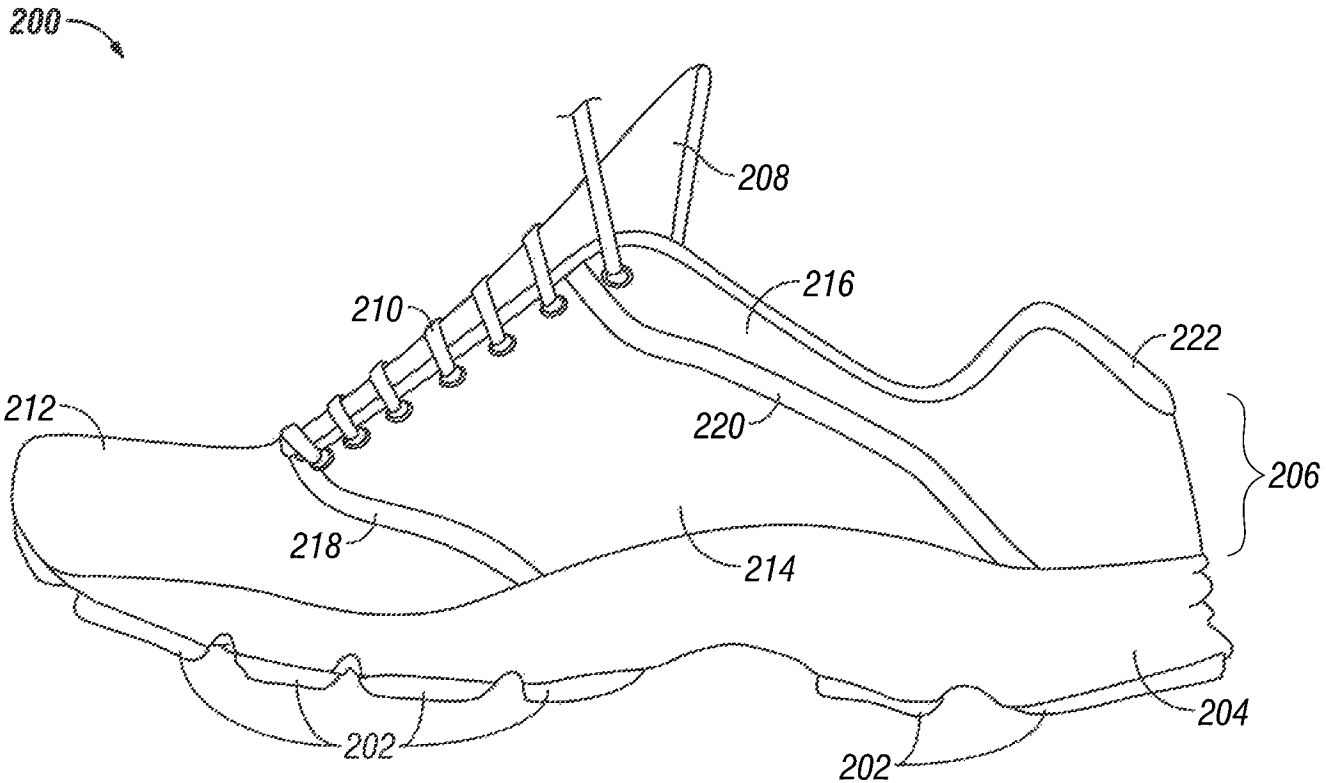
FIG. 2 shows a shoe having an upper in accordance with one embodiment of the present invention.

FIG. 2 shows a shoe 200. Shoe 200 is comprised of an outsole 202, a midsole 204, and an upper 206. An insole is typically included within the shoe, but is not shown in the figure. Outsole 202 is typically comprised of a wear-resistant rubber material. Midsole 204 is typically comprised of an ethylene-vinyl acetate (EVA) material. Alternatively, midsole 204 may be comprised of alternative materials. The shoe is completed with a tongue portion 208 and shoelaces 210. Tongue portion 208 and shoelaces 210, are optional as would be known to one of skill in the art. Further, the materials comprising outsole 202 and midsole 204 may be chosen as deemed fit by one of skill in the art.

Upper 206, as shown in FIG. 2, is comprised of a forefoot panel 212, a mid-section panel 214, and a rearfoot panel 216. Forefoot panel 212 extends over a portion of the sole corresponding to a forefoot area of the wearer's foot. Mid-section panel 214 extends over a portion of the sole corresponding to a midfoot area of the wearer's foot. Rearfoot panel 216 extends over a portion of the sole corresponding to a rearfoot area of the wearer's foot. Upper 206 also includes a first expansion joint 218. First expansion joint 218 joins forefoot panel 212 to mid-section panel 214. Upper 206 also includes a second expansion joint 220. Second expansion joint 220 joins mid-section panel 214 to rearfoot panel 216. Optionally, a comfort padding 222 is added to upper 206.

The number of panels that comprise upper 206 is not restricted to just three panels. Any number of panels between two and about seven may be used. The objective of the panels is to mimic the relative movement of the different areas of the foot. For that reason, three panels are preferred because the foot is generally divided into three main divisions; specifically the forefoot, midfoot, and rearfoot. In this manner, upper 206 can move with the foot. In a typical shoe, the lack of stretch and mobility in the upper creates relative movement between the foot and the upper, which in turn creates blisters and sore spots. In contrast to a typical shoe, the mobility between panels 212, 214, and 216 in upper 206 works to prevent blisters and sore spots.

The expansion joints are preferably formed of a synthetic material. For example, the expansion joints may be formed of a midbacker coated with polyurethane. The midbacker can be a material such as spandex. Alternatively, the expansion joints may be straight textile spandex. Preferably, the expansion joints are formed of a four-way stretch material. In alternative embodiments the expansion joints may be formed of a two-way stretch material. Further, the expansion joints are preferably formed of a material having a greater stretch characteristic than that of the panels. For example, under an Elastic Gore Retention test, a preferred material for the expansion joints would have a maximum stretch retention of less than 15%, and more preferably a maximum stretch retention of less than 5%.

The expansion joints are typically attached to the panels through a zig-zag stitch between the panels. After stitching, the panels may be overlaid with a synthetic material. In a preferred embodiment, the panels are separated from each other by a gap of about three to four millimeters. In alternative embodiments, the expansion joints may be sewn on, RF welded, or attached to the panels by any other attachment operation known to the art.

Figure 3:
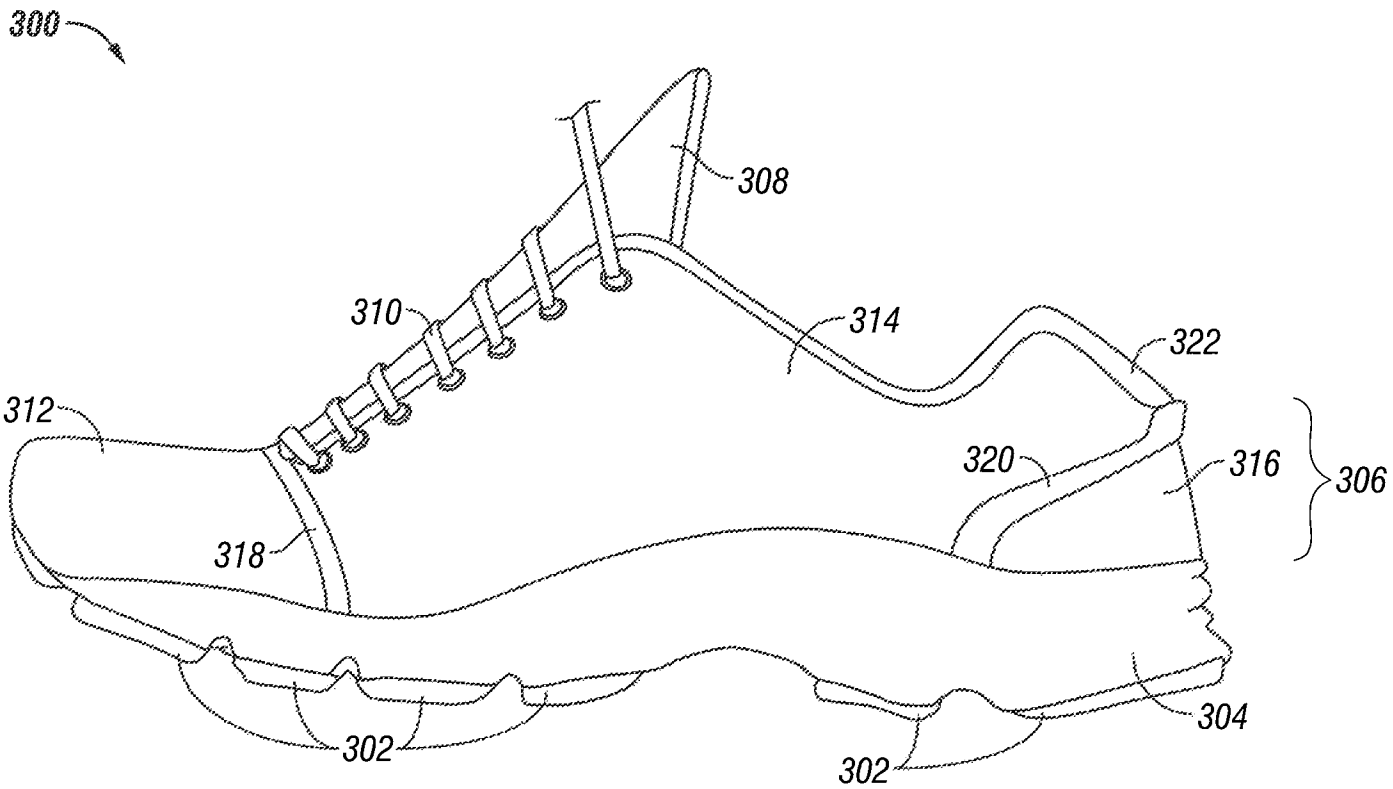
FIG. 3 shows a shoe having an upper in accordance with an alternative embodiment of the present invention.

FIG. 3 shows a shoe 300, in accordance with an alternative embodiment of the present invention. Shoe 300 is different from shoe 200 of FIG. 2 by having an alternative upper 306. Upper 306 is comprised of forefoot panel 312, mid-section panel 314, and rearfoot panel 316. An expansion joint 318 joins forefoot panel 312 to mid-section panel 314. A second expansion joint 320 joins mid-section panel 314 to rearfoot panel 316. Expansion joint 320 of shoe 300 differs from the expansion joint 220 of shoe 200 in that expansion joint 320 extends from the back of the shoe to the midsole 304. Such an embodiment adds design flexibility, while still functioning in accordance with the objectives of the present invention.

Figure 4:
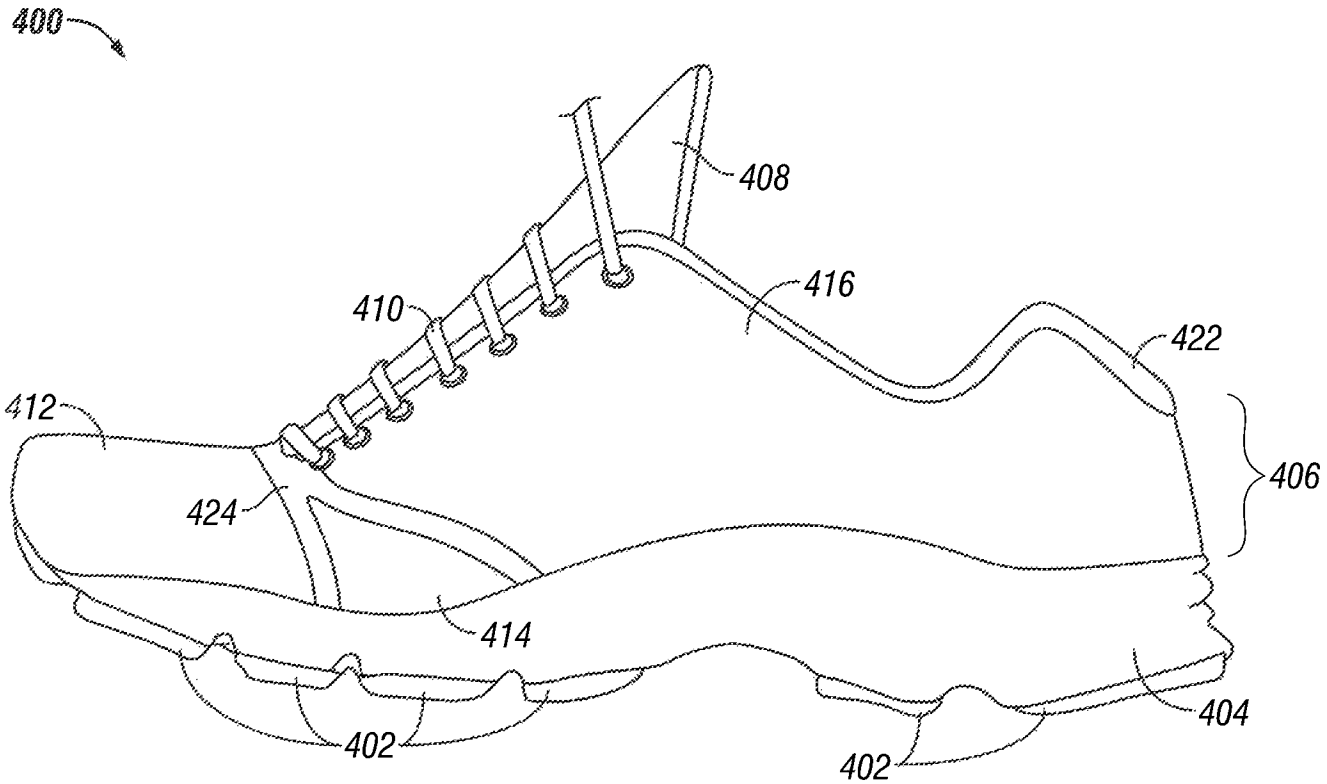
FIG. 4 shows a shoe having an upper in accordance with another embodiment of the present invention.

FIG. 4 shows a shoe 400, in accordance with an alternative embodiment of the present invention. Shoe 400 differs from the previously described shoes in that shoe 400 does not include multiple expansion joints. Instead, shoe 400 includes a single expansion joint 424, which is one integral unit that forks in two directions. As such, each panel (forefoot panel 412, mid-section panel 414, and rearfoot panel 416) is attached to a portion of expansion joint 424. In the embodiment shown in FIG. 4, mid-section panel 414 does not correlate exactly with the midfoot, but instead correlates with a portion of the foot between the forefoot panel 412 and the rearfoot panel 416. The design of shoe 400, however, does not depart from the objectives of the present invention. Shoe 400 still allows relative mobility of the individual portions of upper 406, which in turn correspond to the relative movement of the different parts of a wearer's foot.

Figure 5:
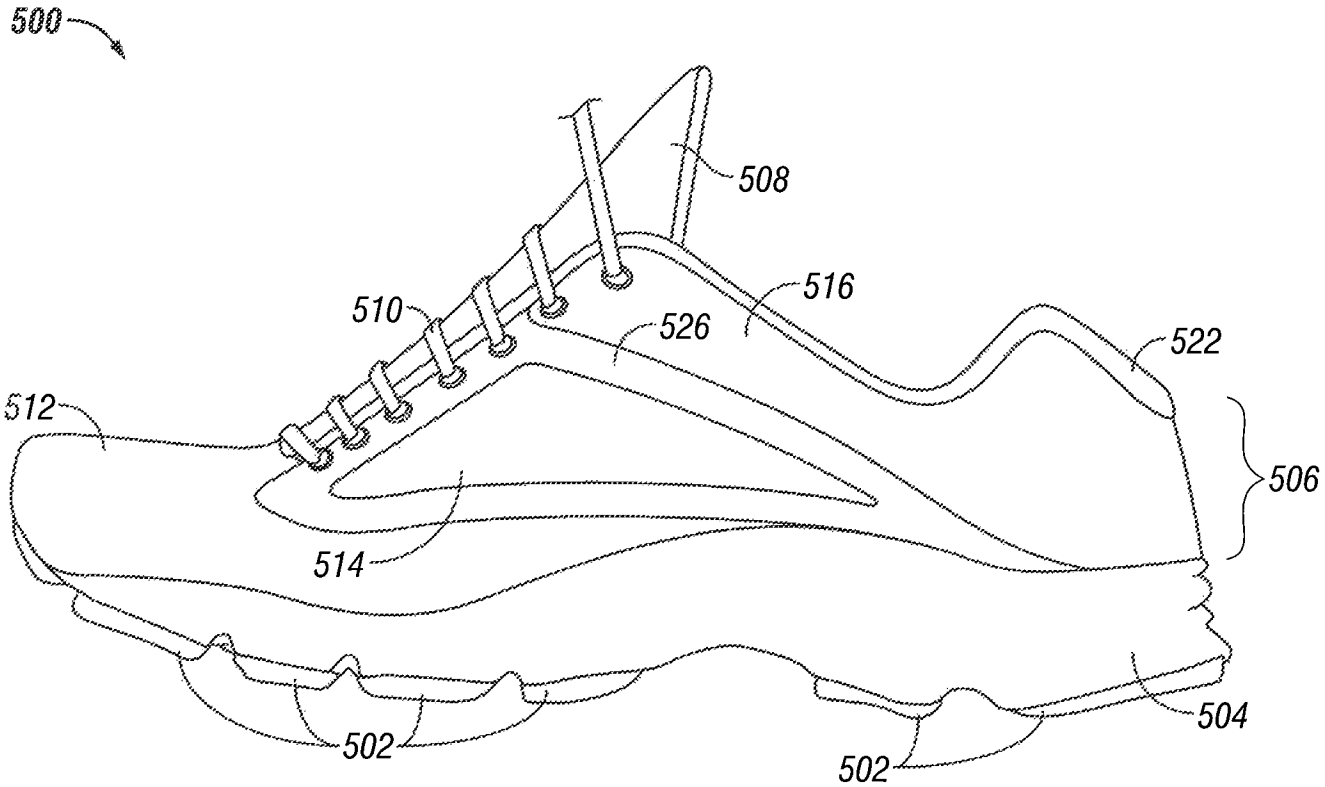
FIG. 5 shows a shoe having an upper in accordance another embodiment of the present invention.

FIG. 5 shows a shoe 500 in accordance with another embodiment of the present invention. Shoe 500 differs from the previously described shoes in that expansion joint 526 forms one integral unit with a central opening. As such, each panel (forefoot panel 512, mid-section panel 514, and rearfoot panel 516) is attached to a portion of expansion joint 526. Specifically, mid-section panel 514 is disposed within the central opening of expansion joint 526. The design of shoe 500, however, does not depart from the objectives of the present invention. Shoe 500 still allows relative mobility of the individual portions of upper 506, which in turn correspond to the relative movement of the different parts of a wearer's foot.

Figure 6:
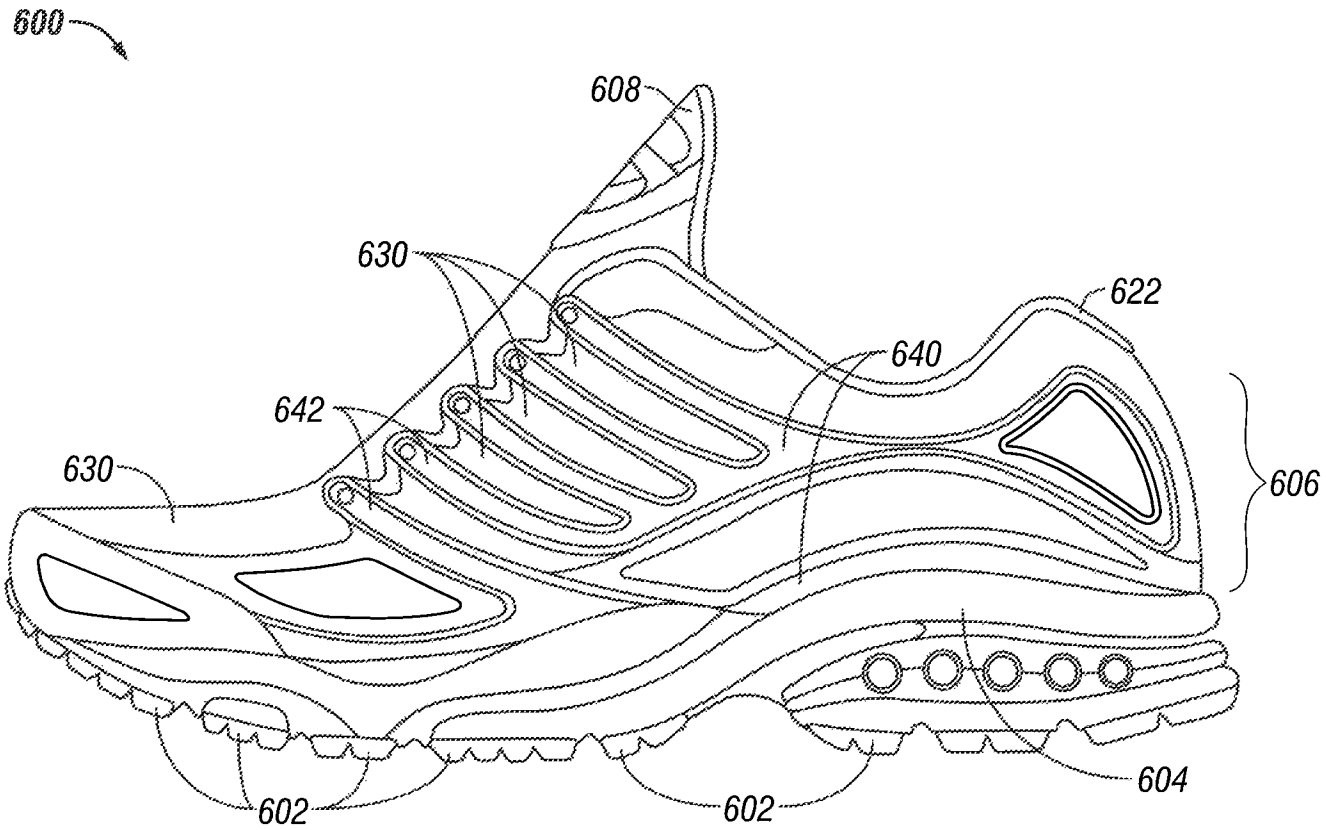
FIG. 6 shows a shoe having an upper in accordance with another embodiment of the present invention.

FIG. 6 shows a shoe 600 in accordance with another embodiment of the present invention. The alternative design of shoe 600 does not depart from one objective of the present invention; that being to provide a kinetic fit for a shoe that provides adequate support while also providing adequate flexibility to mirror the movement of the various skeletal sections of a user's foot. Shoe 600 comprises an upper 606 formed of a stretch mesh material 630 extending throughout the shoe. A non-stretch synthetic material 640, such as for example a synthetic leather, is provided throughout the upper to provide adequate support. In one embodiment, non-stretch material 640 is laid over stretch mesh material 630 and attached to stretch mesh material 630 by conventional means. In one embodiment, non-stretch material 640 has a plurality of "fingers" 642 that extend upward from the bottom of upper 606. In between fingers 642 is stretch material 630. As such, stretch material 630 serves as expansion joints between fingers 642. In one embodiment, upper 606 includes up to about fifteen millimeters, and preferably between about ten and about fifteen millimeters, of non-stretch material 640 running along the base of upper 606—where upper 606 attaches to midsole 604.

Figure 7:
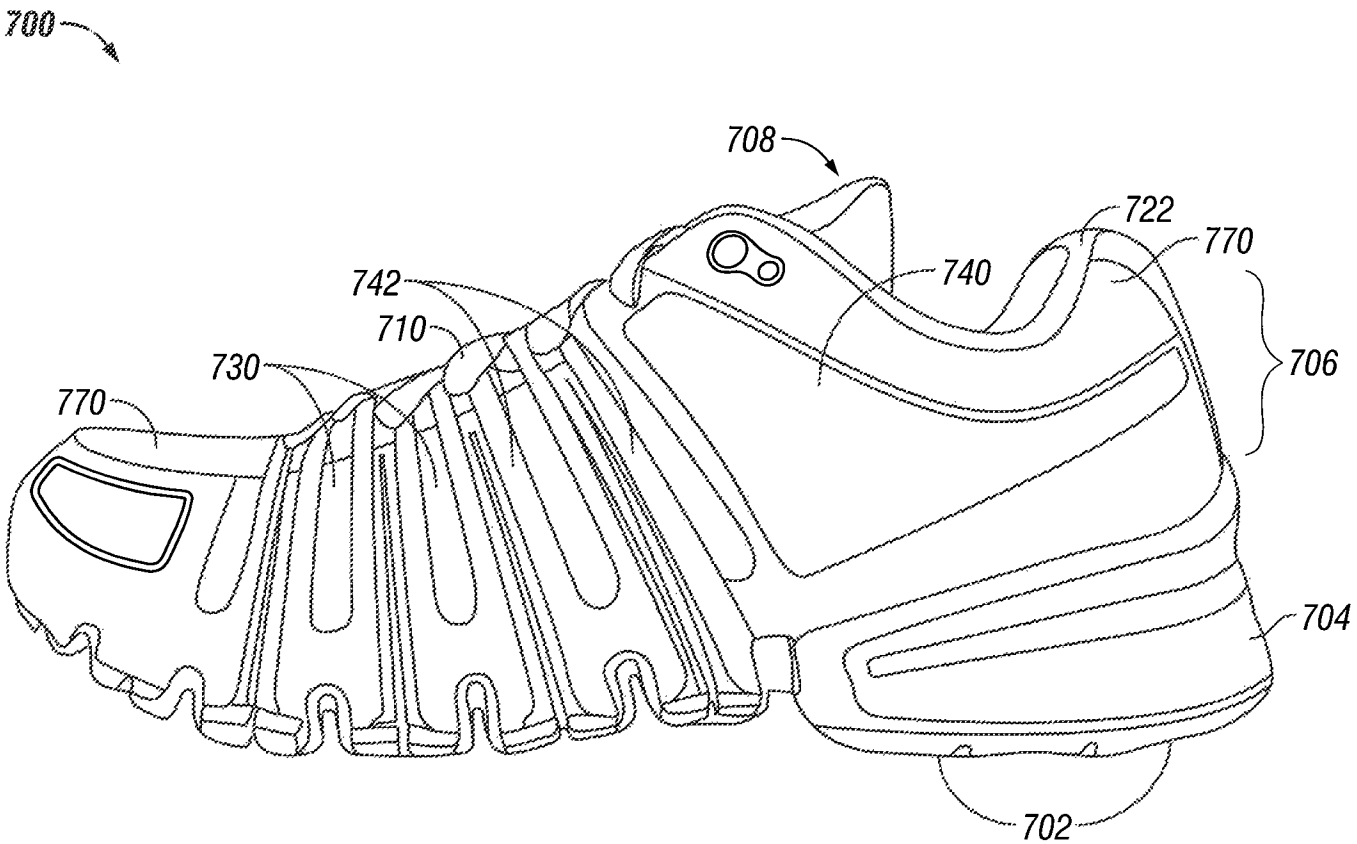
FIG. 7 shows a shoe having an upper in accordance with another embodiment of the present invention.

FIG. 7 shows a shoe 700 in accordance with another embodiment of the present invention. The alternative design of shoe 700 does not depart from one objective of the present invention; that being to provide a kinetic fit for a shoe that provides adequate support while also providing adequate flexibility to mirror the movement of the various skeletal sections of a user's foot. Shoe 700 comprises an upper 706 formed primarily of a non-stretch portion 740, a woven-fabric portion 770, and a stretch mesh portion 730. The non-stretch portion 740 may be made of a synthetic leather, natural leather, or any other conventional material. Non-stretch portion 740 is provided throughout a significant portion of the upper to provide adequate support. The stretch mesh portion 730 is provided in select locations to provide adequate flexibility throughout the upper.

In one embodiment, non-stretch portion 740 is laid over stretch mesh portion 730 and attached to stretch mesh portion 730 by conventional means. In one embodiment, non-stretch portion 740 has a plurality of "fingers" 742 that extend upward from the bottom of upper 706. In between fingers 742 is stretch mesh portion 730. In one embodiment, shoe 700 includes five stretch mesh portions 730 on each side of shoe 700. Each of the five stretch mesh portions 730 on each side of shoe 700 may be sewn between the fingers 742. In alternative embodiments, any number of stretch mesh portions 730 may be employed. For example, in one embodiment, only one stretch mesh portion 730 is disposed on each side of shoe 700. Such embodiment may have the stretch mesh portion 730 disposed over a portion of the shoe that approximately corresponds with the arch of a wear's foot.

As such, stretch mesh portion 730 serves as expansion joints between fingers 742. Shoe 700 may include shoelaces 710, tongue portion 708, comfort padding 722, and outsole 702, as described in the previous embodiments above. In one embodiment, upper 706 includes up to about fifteen millimeters, and preferably between about ten and about fifteen millimeters, of non-stretch material 740 running along the base of upper 706—where upper 706 attaches to midsole 704.

Figure 8:
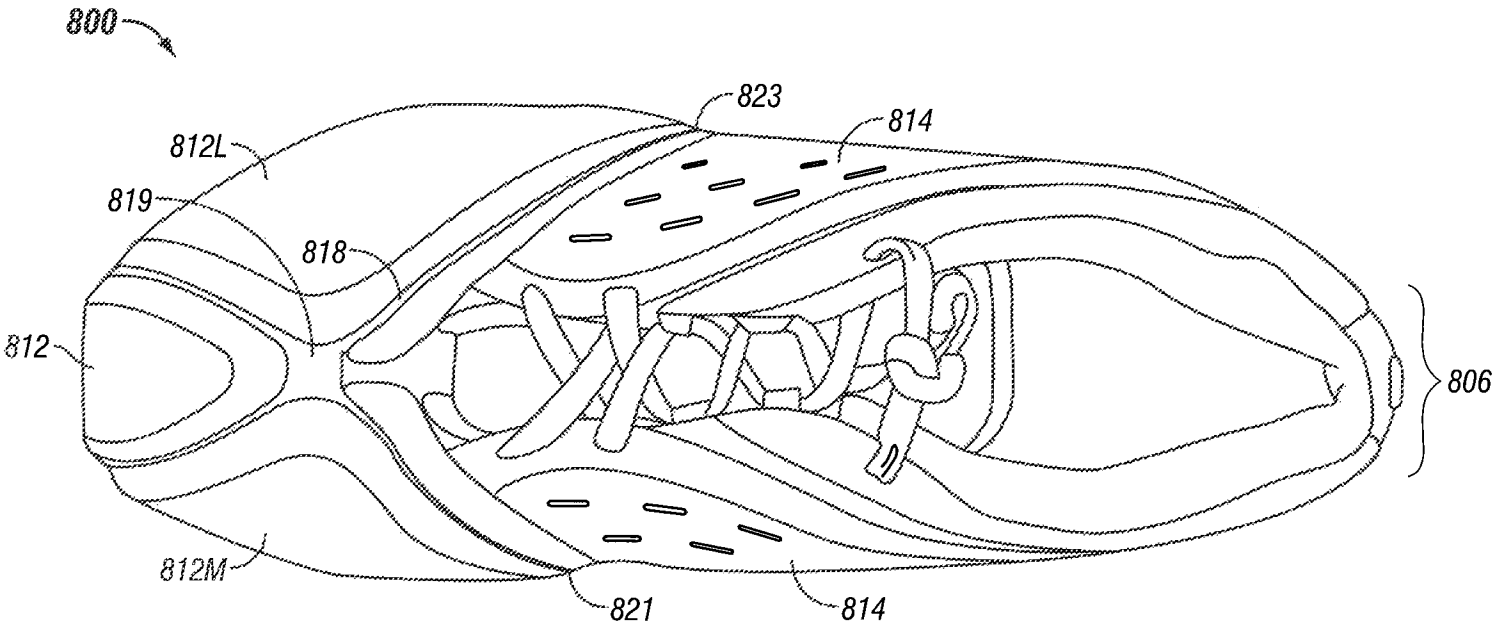
FIG. 8 is a top view of a shoe in accordance with an alternative embodiment of the present invention.
Figure 8B:
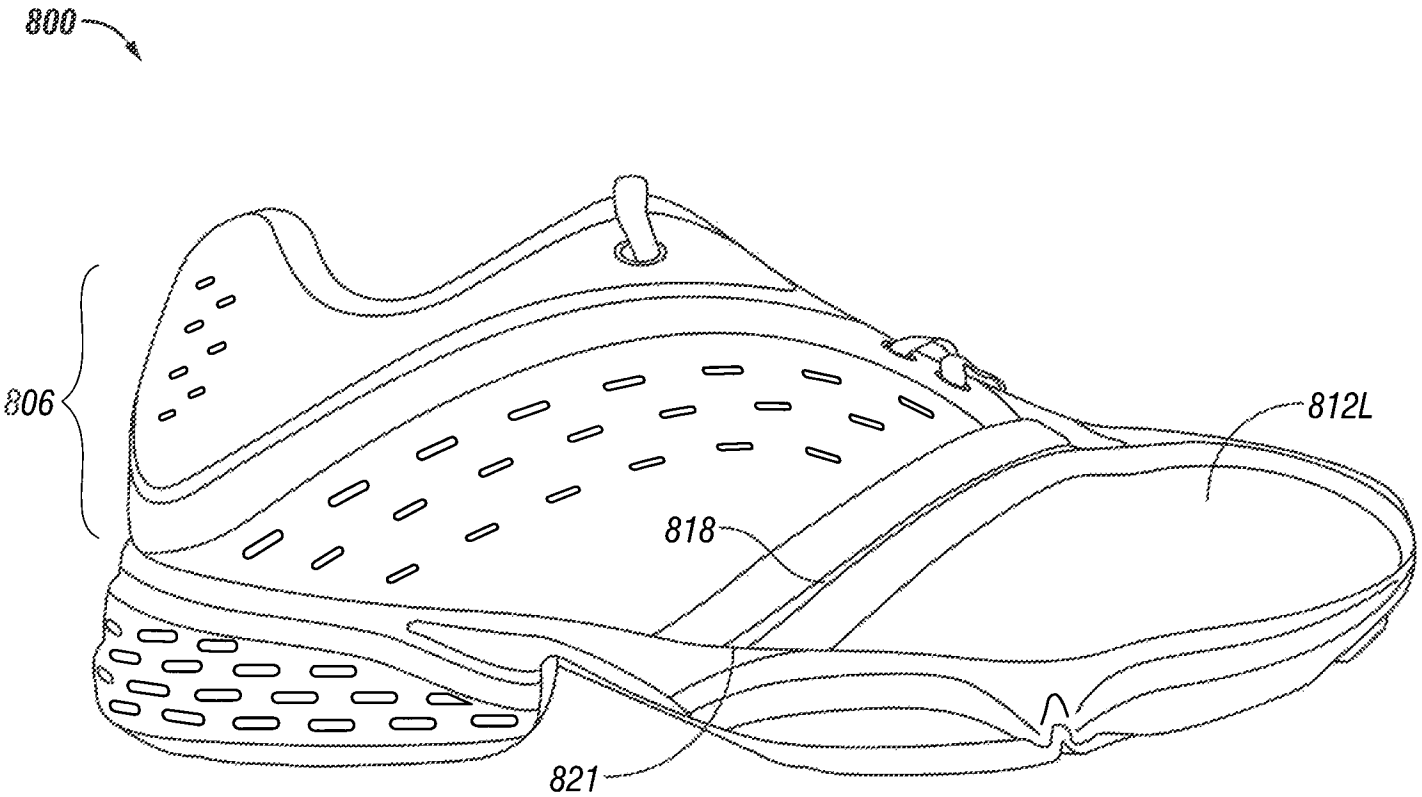
FIG. 8B is a side view of the shoe of FIG. 8.

FIG. 8 is a top view of a shoe 800 in accordance with an alternative embodiment of the present invention. FIG. 8B is a side view of shoe 800 of FIG. 8. Shoe 800 is similar to the shoe 200 of FIG. 2, but shows an alternative upper 806. Upper 206 of shoe 200, as shown in FIG. 2, is comprised of a single forefoot panel 212, a mid-section panel 214, and a rearfoot panel 216. However, as stated above, the number of panels that comprise upper 206 is not limited to just three panels. FIG. 8 shows one such alteration to the upper. In FIG. 8, the forefoot is segmented into three forefoot panels 812, 812M, and 812L, which extend over a portion of the sole corresponding to a forefoot area of the wearer's foot. Mid-section panels 814 extend over a portion of the sole corresponding to the midfoot area of the wearer's foot. An expansion joint 818 forms an approximate X-shape across the forefoot portion of shoe 800. The three forefoot panels 812, 812M, and 812L are then disposed within three of the four quadrants formed by the approximate X-shape configuration. In other words, expansion joint 818 extends from a point 821, at approximately the arch area of the medial side of shoe 800, and a point 823, at approximately the arch area of the lateral side of shoe 800, to a center point 819, at approximately the center of the forefoot area of shoe 800. Expansion joint 818 then extends from center point 819 to two points along the front end of shoe 800. As such, the X-shape configuration is formed by four extensions departing from center point 819. Two of the extensions extend from center point 819 to a front portion of the sole. One extension extends from center point 819 to a medial side of the sole. One extension extends from center point 819 to a lateral side of the sole.

Figure 9:
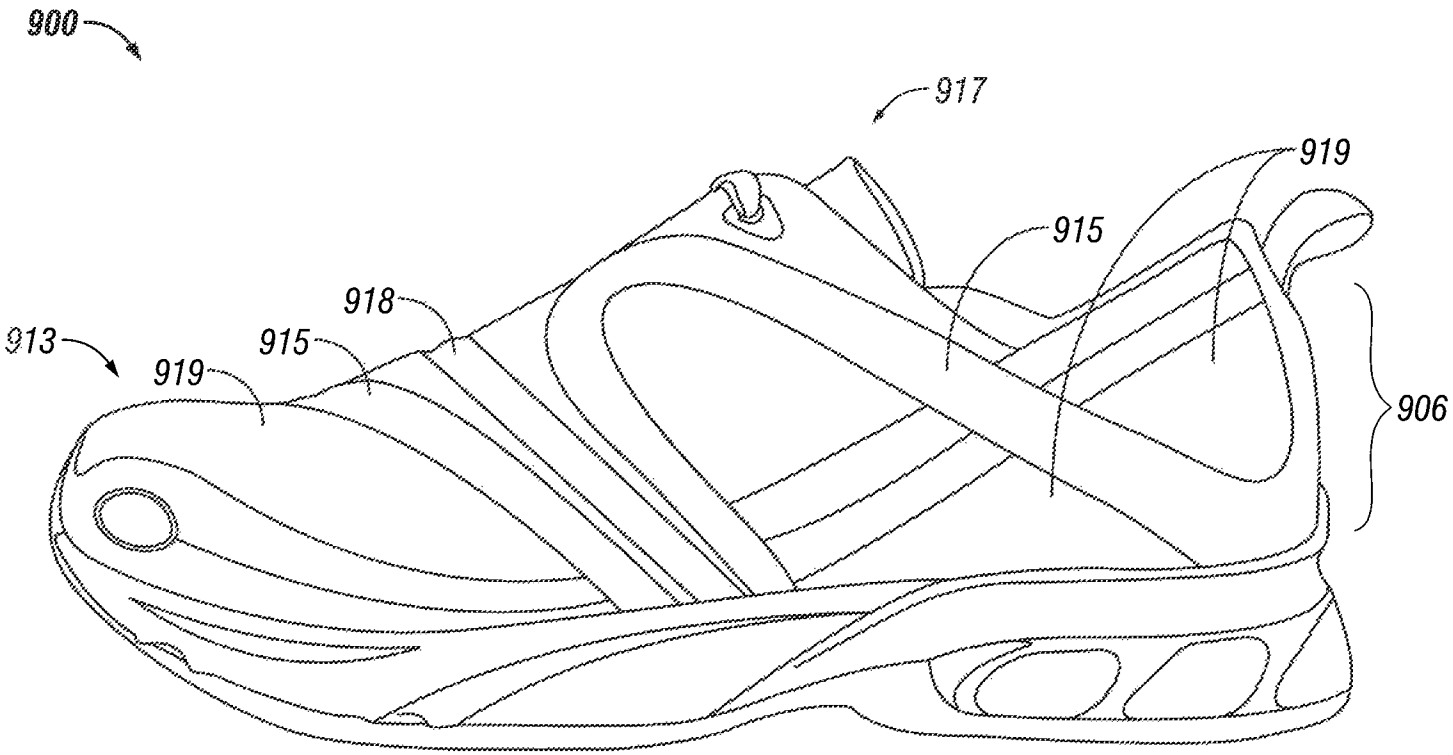
FIG. 9 shows a shoe in accordance with an alternative embodiment of the present invention.

FIG. 9 shows a shoe 900 in accordance with an alternative embodiment. Shoe 900 is similar to the shoe 200 of FIG. 2, but shows an alternative upper 906. Upper 906 is divided between a forefoot portion 913 and a rearfoot portion 917. An expansion joint 918 joins the forefoot portion 913 to the rearfoot portion 917. The expansion joint 918 is formed of a stretch material, while the materials comprising the forefoot portion 913 and rearfoot portion 917 are non-stretch materials. For example, the forefoot portion 913 and rearfoot portion 917 are comprised of woven fabric areas 919 supported by synthetic leather bands 915. In the embodiment shown, the forefoot portion 913 is connected to the rearfoot portion 917 via the expansion joint 918 only. In other words, there is no non-stretch material linking the forefoot portion 913 with the rearfoot portion 917. In an alternative embodiment, shoe 900 includes an inner liner that provides uniformity to the inner wall of shoe 900. Expansion joint 918 may be anywhere from about half a centimeter wide to about ten centimeters wide. Expansion joint 918, while shown on the lateral side of shoe 900, preferably wraps around to the medial side of shoe 900 as well.

Figure 10:
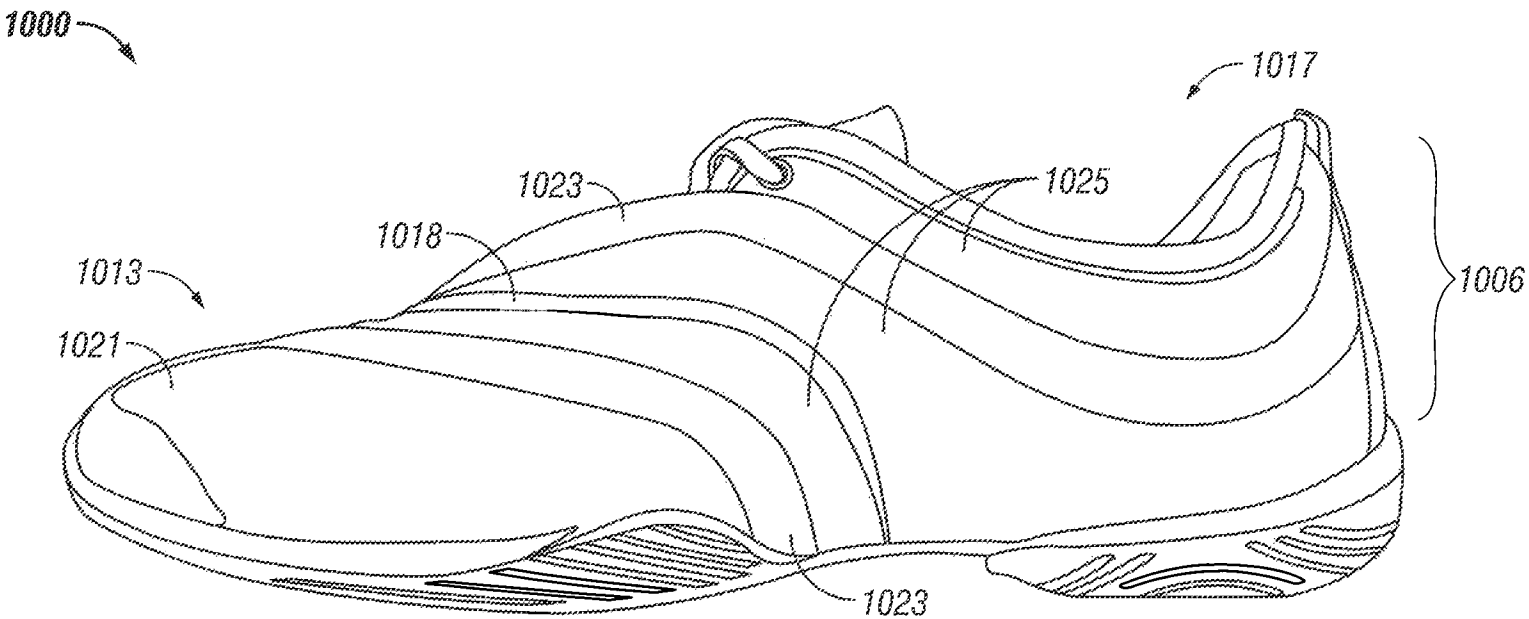
FIG. 10 is a side view of a shoe in accordance with an alternative embodiment of the present invention.
Figure 10B:
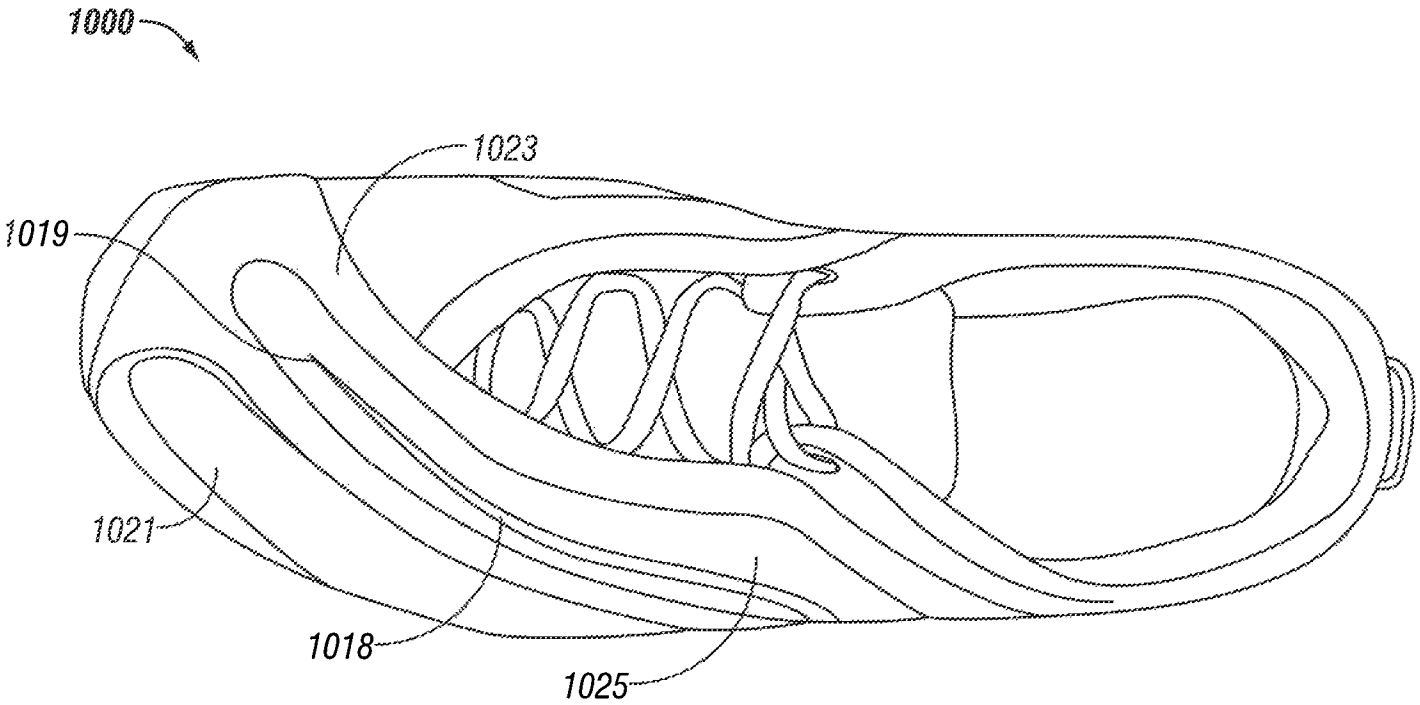
FIG. 10B is a top view of shoe 1000 of FIG. 10.

FIG. 10 is a side view of a shoe 1000, in accordance with an alternative embodiment of the present invention. FIG. 10B is a top view of shoe 1000 of FIG. 10. Shoe 1000 is similar to shoe 900 of FIG. 9, having an expansion joint 1018 divide shoe 1000 between forefoot portion 1013 and rearfoot portion 1017. Shoe 1000 differs from shoe 900 in that expansion joint 1018 does not wrap entirely around upper 1006. Instead, expansion joint 1018 extends from the arch area of upper 1006 to about a center point 1019 in the forefoot of shoe 1000. Shoe 1000 also includes a plurality of non-stretch regions 1021, 1023, and 1025. In the embodiment shown, non-stretch regions 1021, 1023, and 1025 are formed of synthetic leather. Alternative non-stretch materials may be used in lieu of synthetic leather.

The shoes described above may be manufactured by a method comprising: a) securing a portion of a first expansion joint to a portion of a forefoot panel; b) securing a mid-section panel to a portion of the first expansion joint; c) securing a second expansion joint to a portion of the mid-section panel; and d) securing a rearfoot panel to a second portion of the second expansion. The panels may be secured to one another by being sewn together, by an RF welding technique, or using a zig-zag stitch technique. The upper is then preferably attached to a sole of a shoe. In an alternative method presented herein, a portion of an end of the forefoot panel is spaced about three to four millimeters from a portion of a first end of the mid-section panel, and a portion of a second end of the mid-section panel is spaced about three to four millimeters from a portion of an end of the rearfoot panel.

The shoes described above may also be manufactured by the alternative method of: a) providing one unitary upper formed of a stretch material; and b) securing onto the stretch material a second material, which is less stretchable than said stretch material.

Although it is acknowledged that most materials are stretchable to a certain extent, as used herein the terms "stretch material," "stretchable material," "non-stretch material," and "non-stretchable material" are terms of art. More specifically, the term "stretch" or "stretchable" is intended to refer to materials which have a maximum stretch retention of less than 15%, and more preferably a maximum stretch retention of less than 5%, under an Elastic Gore Retention test. In such a test, a swatch of material is first measured in an unloaded and neutral state. The material is then stretched or extended to, for example, one and a half times its original length and/or width. The material is then measured again in an unloaded and neutral state. The second measurement is intended to determine the material's ability to return to its original size. A material that returns to within 15% of its original size, may be considered a "stretch" or "stretchable" material. However, materials that either fail during extension, or do not return to within 15% of its original size, may be considered a "non-stretch" or "non-stretchable" material.

Figure 1:
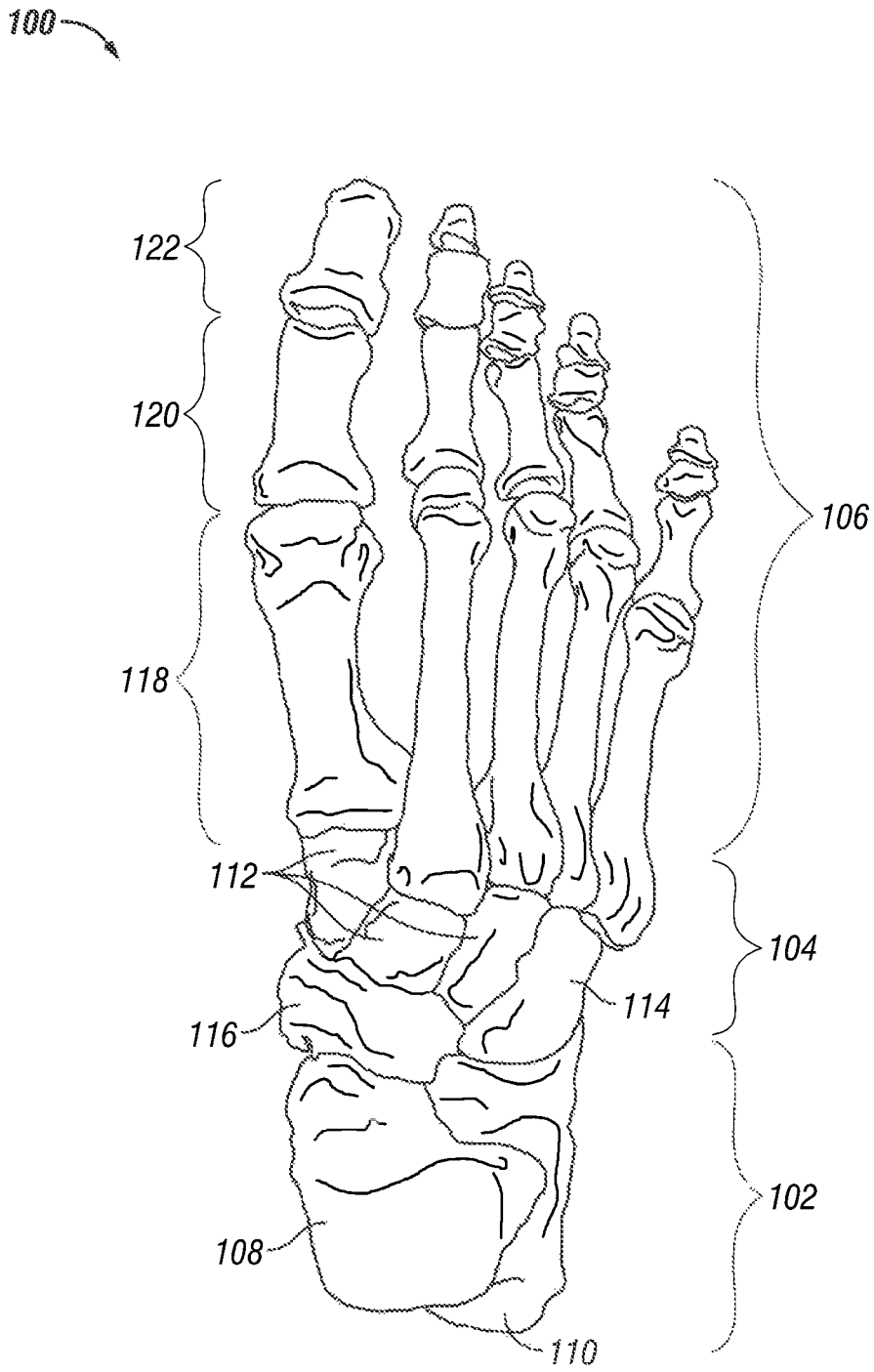
FIG. 1 shows a skeletal depiction of the foot.

While various embodiments of an athletic shoe have been described, it should be understood that they have been presented by way of example, and not limitation. For example, the illustrated design and direction of the expansion joints were not intended to be limiting. Further, the forefoot, mid-section, and rearfoot panels may take on any form or configuration desirable to a designer. Further, the terms "forefoot," "mid-section," "midfoot," and "rearfoot" are not intended to be limited to the exact bone structure of a wearer's foot, or the bone structure shown in FIG. 1. Instead, the terms are used solely to designate a forward area of the foot, a middle area of the foot, and a rear area of the foot, respectively. Also, where only one side of a shoe is shown in the figures, it would be apparent to one of skill in the art that the other side of the shoe could be the mirror image of that shown. In alternative embodiments, however, expansion joints may be included in the medial side of the shoe only, the lateral side of the shoe only, or both the medial and lateral side of the shoe. The number, location, design, and direction of the expansion joints may be altered in any fashion as would be deemed fit by a designer. Further, although athletic shoes are shown in the figures, the present invention may be employed in any article of footwear such as a boot, dress shoe, sandal, cleats, snowshoes, ski boots, snowboard boot, etc.

It will be apparent to a person skilled in the relevant art that various changes in form and detail can be made therein without departing from the spirit and scope of the appended claims. For example, the upper could be made to conform to the movement of the foot by using numerous expansion joints, at various locations, to allow the upper to move with the movement of the foot while retaining sufficient support. The expansion joints need not be formed of the same material. Portions of the foot which require more expansion may use a material having a different stretch property than the material used in portions of the foot having less movement. Thus, a shoe can be tailored to accommodate the specific movements of the foot. Thus the present invention should not be limited by any of the above-described exemplary embodiments, but should be defined only in accordance with the following claims and their equivalents.

What is claimed is:

1. An article of footwear having a sole and an upper attached to the sole, wherein the upper comprises:

a forefoot portion;

a mid-section portion;

a rearfoot portion; and an expansion joint comprising a first elongated portion for allowing relative movement between the forefoot portion and the mid-section portion corresponding to relative movement between the forefoot and midfoot of a wearer's foot during use and a second elongated portion for allowing relative movement between the mid-section portion and the rearfoot portion corresponding to relative movement between the midfoot and rearfoot of the wearer's foot during use, the first elongated portion and the second elongated portion intersecting at a portion of the upper proximate a top edge of the upper;

wherein the first elongated portion is disposed between the forefoot portion and the mid-section portion, wherein the second elongated portion extends along adjacent linear edges of the mid-section portion and the rearfoot portion, wherein the forefoot portion, the mid-section portion, and the rearfoot portion are formed of non-stretch materials; and wherein the mid-section portion is in contact with the sole.

2. The article of footwear defined in claim 1, wherein the expansion joint comprises a two-way expandable material.

3. The article of footwear defined in claim 1, wherein the expansion joint comprises a four-way expandable material.

4. The article of footwear defined in claim 1, wherein the expansion joint comprises a spandex material.

5. The article of footwear defined in claim 1, wherein the expansion joint comprises a spandex material having a polyurethane coating.

6. The article of footwear defined in claim 1, wherein the expansion joint is comprised of a material having a stretch retention of less than about 5%.

7. The article of footwear defined in claim 1, wherein a portion of the expansion joint is about one half a millimeter to about ten millimeters wide.

8. The article of footwear defined in claim 1, wherein a portion of the expansion joint is about two millimeters to about eight millimeters wide.

9. The article of footwear defined in claim 1, wherein a portion of the expansion joint is about three millimeters to about four millimeters wide.

10. The article of footwear defined in claim 1, wherein the first elongated portion and the second elongated portion intersect proximate to a foremost portion of the top edge of the upper.

11. The article of footwear defined in claim 1, wherein the at least one expansion joint defines holes proximate the top edge portion of the upper.

12. The article of footwear defined in claim 1, wherein the rearfoot portion is in contact with the sole.

13. The article of footwear defined in claim 1, wherein the expansion joint comprises at least one end in contact with the sole.

14. The article of footwear defined in claim 1, wherein the expansion joint comprises at least two ends in contact with the sole.

15. An article of footwear having a sole and an upper attached to the sole, wherein the upper comprises:

a forefoot portion;

a mid-section portion;

a rearfoot portion; and an expansion joint portion comprising a first elongated portion and a second elongated portion, the first elongated portion and the second elongated portion intersecting at a portion of the upper proximate to the sole, wherein the first elongated portion is disposed between the forefoot portion and the mid-section portion, wherein the second elongated portion is disposed between the mid-section portion and the rearfoot portion, wherein the forefoot portion, the mid-section portion, and the rearfoot portion are formed of non-stretch materials, wherein the mid-section portion has a triangular shape, and wherein the expansion joint is configured to allow relative movement among the forefoot portion, the mid-section portion, and the rearfoot portion that corresponds to relative movement between bone structures of a wearer's foot.

16. The article of footwear defined in claim 15, wherein the expansion joint further comprises a third elongated portion disposed along a top edge portion of the upper that intersects with ends of both the first elongated portion and the second elongated portion.

17. The article of footwear defined in claim 15, wherein the triangular shape has two vertices proximate a top edge portion of the upper.

18. The article of footwear defined in claim 15, wherein the at least one expansion joint defines holes proximate the top edge portion of the upper.

* * * * *